US009315966B2

(12) United States Patent
Sugaya et al.

(10) Patent No.: US 9,315,966 B2
(45) Date of Patent: Apr. 19, 2016

(54) ARM FOR CONSTRUCTION MACHINE WITH UPPER ENDS OF REAR PLATE PROTRUDING UPWARD

(75) Inventors: Makoto Sugaya, Narita (JP); Takeshi Takahashi, Tsukuba (JP); Takayuki Shimodaira, Ryugasaki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 226 days.

(21) Appl. No.: 14/003,352

(22) PCT Filed: May 16, 2012

(86) PCT No.: PCT/JP2012/062515

§ 371 (c)(1),
(2), (4) Date: Sep. 5, 2013

(87) PCT Pub. No.: WO2012/157676

PCT Pub. Date: Nov. 22, 2012

(65) Prior Publication Data

US 2013/0343854 A1 Dec. 26, 2013

(30) Foreign Application Priority Data

May 19, 2011 (JP) ..... 2011-112822

(51) Int. Cl.
*E02F 3/38* (2006.01)

(52) U.S. Cl.
CPC ..... *E02F 3/38* (2013.01)

(58) Field of Classification Search
CPC ..... E02F 3/38
See application file for complete search history.

(56) References Cited

U.S. PATENT DOCUMENTS

| | | | | |
|---|---|---|---|---|
| 3,902,295 | A * | 9/1975 | Yancey | 414/722 |
| 2003/0118433 | A1 * | 6/2003 | Janes et al. | 414/722 |
| 2003/0126772 | A1 | 7/2003 | Masumoto et al. | |

FOREIGN PATENT DOCUMENTS

| | | | |
|---|---|---|---|
| JP | 59-092166 | A | 5/1984 |
| JP | 2003-261956 | A | 9/2003 |
| JP | 2005-029984 | A | 2/2005 |
| JP | 2005-213819 | A | 8/2005 |
| WO | 2010/110024 | A1 | 9/2010 |
| WO | WO 2010110024 | A1 * | 9/2010 |

OTHER PUBLICATIONS

Extended European Search Report received in corresponding European Application No. 12786625.9 dated Feb. 11, 2015.

* cited by examiner

*Primary Examiner* — Gerald McClain
(74) *Attorney, Agent, or Firm* — Mattingly & Malur, PC

(57) ABSTRACT

An arm of a hydraulic excavator is formed as a box-shaped structural body surrounded by left and right side plates, an upper plate, a lower plate, and a thick rear plate. An upper end of the thick rear plate is protruded upward from an outer surface of the upper plate. Upper ends of a pair of arm cylinder brackets joined to an outer surface of the thick rear plate are arranged higher than the outer surface of the rear thick upper plate and lower than the upper end of the thick rear plate. As a result, in each of the arm cylinder brackets, a joint area with the thick rear plate can be ensured large, and joint strength can be improved.

3 Claims, 9 Drawing Sheets

ARM FOR CONSTRUCTION MACHINE WITH UPPER ENDS OF REAR PLATE PROTRUDING UPWARD

TECHNICAL FIELD

The present invention relates to an arm for construction machine suitably used in a working mechanism mounted on a construction machine such as a hydraulic excavator and the like, for example.

BACKGROUND ART

In general, a hydraulic excavator which is a typical example of a construction machine is composed of an automotive lower traveling structure and an upper revolving structure rotatably mounted on the lower traveling structure. On the front side of a revolving frame constituting the upper revolving structure, a working mechanism performing excavating work of earth and sand and the like is provided capable of moving upward/downward.

Here, the working mechanism of a hydraulic excavator is usually composed largely of a boom having the base end side rotatably mounted on the revolving frame, an arm rotatably mounted on the distal end side of the boom, a working tool such as a bucket or the like rotatably mounted on the distal end side of the arm, and a boom cylinder, an arm cylinder, and a bucket cylinder driving these boom, the arm, and the bucket, respectively.

The arm constituting such working mechanism is usually formed as a lengthy welded structural body whose whole length is as long as several meters. That is, the arm is formed of left and right side plates, an upper plate joined to the upper end sides of these left and right side plates by welding, a lower plate joined to the lower end sides of the left and right side plates by welding, and a rear plate joined to the rear end sides of the left and right side plates and the upper plate by welding. As a result, the arm is formed as a box-shaped structural body having a square cross sectional surface with a closed sectional structure.

On a front end of the arm, a bucket connecting boss to which a bucket is mounted is provided, and on a rear part on the lower side of the arm, a boom connecting boss to be connected to the distal end side of the boom by using a connecting pin is provided. On the other hand, on the rear end side of the arm, an arm cylinder bracket to which the arm cylinder is connected by using a connecting pin is provided. Moreover, on the rear part on the upper side of the arm, a bucket cylinder bracket to which the bucket cylinder is connected by using a connecting pin is provided (Patent Document 1).

PRIOR ART DOCUMENT

Patent Document

Patent Document 1: Japanese Patent Laid-Open No. 2003-261956 A

SUMMARY OF THE INVENTION

Since the boom connecting boss, the arm cylinder bracket, and the bucket cylinder bracket are provided on the rear side of the arm, strength required for the arm is larger on the rear side and smaller on the front side.

On the other hand, the arm in the above-described conventional art is usually formed of an upper plate and a lower plate by using a single plate material such as a steel plate material having a uniform plate thickness. Thus, on the front side of the arm, the plate thicknesses of the upper plate and the lower plate tend to be too large for the required strength, and there is a problem that a weight of the entire arm becomes larger than necessary.

On the other hand, by decreasing plate thicknesses of the upper plate, the lower plate, the rear plate, the arm cylinder bracket and the like constituting the arm, weight reduction of the arm can be realized. However, the arm cylinder bracket is joined to the rear plate provided on the rear end of the arm by welding, and a large load accompanying extension/contraction of the arm cylinder acts on this arm cylinder bracket. Thus, a large stress (compression stress, bending stress) acts on the arm cylinder bracket itself or on a welding portion between the arm cylinder bracket and the rear plate. As a result, there is a problem that durability of the entire arm including the arm cylinder bracket deteriorates.

In view of the above-described conventional art problem, it is an object of the present invention to provide an arm for a construction machine which can reduce the weight of the entirety while ensuring required strength.

(1) In order to solve the above-described problems, the present invention is applied to an arm for a construction machine formed as a box-shaped structural body having a square cross sectional surface having left and right side plates, an upper plate joined to the upper end sides of the left and right side plates by welding, a lower plate joined to the lower end sides of the left and right side plates by welding, and a rear plate joined to the rear end sides of the left and right side plates and to the rear end side of the upper plate by welding, comprising: a boom connecting boss located on the rear parts on the lower sides of the left and right side plates and joined to the left and right side plates and the rear ends of the lower plate and the front end of the rear plate by welding; a bucket connecting boss joined to the front ends of the left and right side plates, the upper plate, and the lower plate by welding; and a pair of left and right arm cylinder brackets joined to an outer surface of the rear plate by welding.

A characteristic of the present invention is that an upper end of the rear plate is provided by protruding upward from a height position of an outer surface of the upper plate; and upper ends of the pair of arm cylinder brackets are arranged higher than a height position of the outer surface of the upper plate and at a position lower than the upper end of the rear plate.

With this arrangement, by arranging the upper ends of the pair of arm cylinder brackets higher than the height position of the outer surface of the upper plate and lower than the upper end of the rear plate, a facing area facing the rear plate, that is, a joint area of each of the arm cylinder brackets can be formed large. As a result, strength of each of the arm cylinder brackets itself against the load can be improved. On the other hand, a welding length between each of the arm cylinder brackets and the rear plate can be ensured large, and joint strength of each of the arm cylinder brackets to the rear plate can be improved.

Moreover, by protruding the upper end of the rear plate upward from the height position of the outer surface of the upper plate, its rigidity becomes relatively low, and in the upper end side of the rear plate, appropriate deflection is generated in accordance with a load acting on the upper end portion of the arm cylinder bracket. Thus, the load acting on the upper end portion of the arm cylinder bracket can be absorbed by deflection on the upper end side of the rear plate and concentration of stress generated in the joint portion (welding stop end portion) between the upper end of the arm cylinder bracket and the rear plate can be reduced. As a result, plate thickness of each of the arm cylinder brackets can be made smaller, while joint strength of the pair of arm cylinder brackets to the rear plate is ensured, and weight reduction of the entire arm can be realized.

(2) According to the present invention, in the pair of arm cylinder brackets, a groove is provided on an end surface brought into contact with the outer surface of the rear plate; and the groove of each of the arm cylinder brackets and the outer surface of the rear plate are joined by fillet welding.

With this arrangement, by applying fillet welding between the groove provided on an end surface of each of the arm cylinder brackets and the outer surface of the rear plate, each of the arm cylinder brackets can be sufficiently blended in the plate thickness direction and can be firmly joined to the outer surface of the rear plate. As a result, joint strength of the pair of arm cylinder brackets to the rear plate can be further improved, and durability of the arm cylinder bracket can be improved.

(3) According to the present invention, the upper plate is formed of two members, that is, a rear thick upper plate located on the rear side and made of a plate material having a large plate thickness and a front thin upper plate located on the front side of the rear thick upper plate and made of a plate material having a small plate thickness; and the upper ends of the pair of arm cylinder brackets are arranged at a position higher than a height position of the outer surface of the rear thick upper plate.

With this arrangement, since required strength can be ensured by the rear thick upper plate on the rear part side of the arm and weight reduction can be realized by the front thin upper plate on the front part side of the arm, weight reduction of the entire arm can be realized while strength of the upper plate is kept.

MODE FOR CARRYING OUT THE INVENTION

Figure 1:
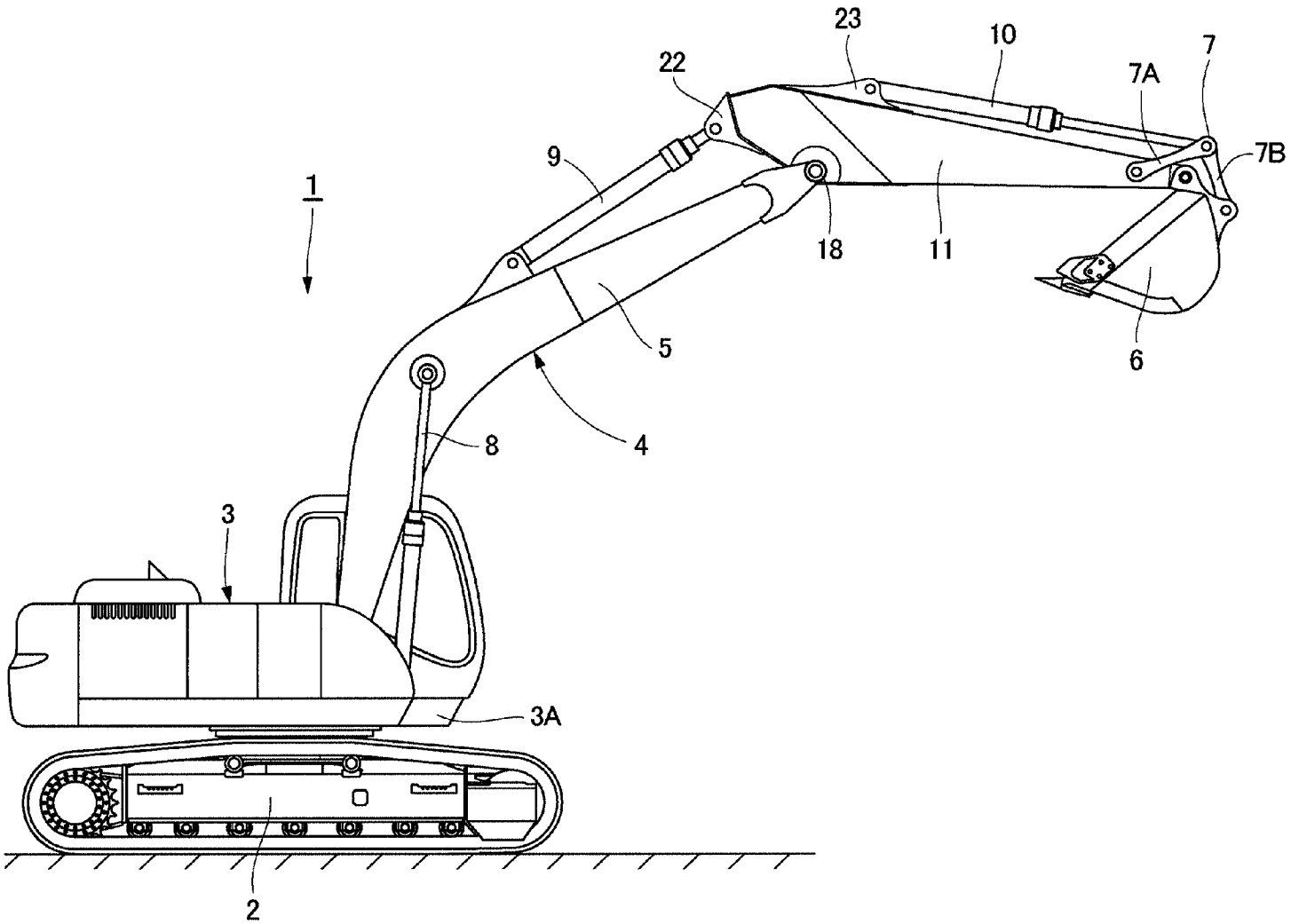
FIG. 1 is a front view illustrating a hydraulic excavator as a construction machine provided with an arm according to the present invention.

Hereinafter, an embodiment of an arm for a construction machine according to the present invention will be described below in detail with reference to the accompanying drawings by using a case applied to an arm of a hydraulic excavator as an example.

Designated at 1 is a hydraulic excavator as a typical example of a construction machine in the drawing, and the hydraulic excavator 1 is provided with an automotive crawler-type lower traveling structure 2 and an upper revolving structure 3 rotatably mounted on the lower traveling structure 2. A working mechanism 4 is provided capable of moving upward/downward on the front part side of a revolving frame 3A which becomes a base of the upper revolving structure 3.

The working mechanism 4 is provided with a boom 5 having a base end portion pin-connected to the front part side of the revolving frame 3A capable of moving upward/downward, an arm 11 which will be described later having a base end portion rotatably pin-connected to a distal end portion of the boom 5, a bucket 6 rotatably pin-connected to a distal end portion of the arm 11, and a bucket link 7 provided between the distal end side of the arm 11 and the bucket 6. Moreover, the working mechanism 4 is provided with a boom cylinder 8 for moving upward/downward the boom 5 with respect to the revolving frame 3A, an arm cylinder 9 for rotating the arm 11 with respect to the boom 5, and a bucket cylinder 10 for rotating the bucket 6 with respect to the arm 11.

Here, the bucket link 7 is composed of a rear link 7A having one end side connected to the distal end side of the arm 11 and a front link 7B having one end side connected to the other end side of the rear link 7A and the other end side connected to the bucket 6. On the other hand, the bottom side of the bucket cylinder 10 is mounted to a bucket cylinder bracket 23 of the arm 11 which will be described later and the rod side of the bucket cylinder 10 is connected to a connection portion between the rear link 7A and the front link 7B of the bucket link 7.

Next, the arm according to this embodiment will be described with reference to FIGS. 2 to 8.

Designated at 11 is the arm rotatably mounted on the distal end portion of the boom 5. This arm 11 is formed as a lengthy box-shaped structural body extending in the front-rear direction as a whole and is rotated in the upper-lower direction by the arm cylinder 9 with respect to the boom 5.

Here, the arm 11 is formed of left and right side plates 12 and 13, an upper plate 14, a lower plate 15, and a thick rear plate 16 which will be described later, and the arm 11 has a box-shaped structural body having a square cross sectional surface with a closed sectional structure as a whole. On the rear side (boom 5 side) of the arm 11, a boom connecting boss 18, an arm cylinder bracket 22, and the bucket cylinder bracket 23 which will be described later are provided. On the other hand, on the front side (bucket 6 side) of the arm 11, a bucket connecting boss 20 and a rear link connecting boss 21 which will be described later are provided.

Figure 4:
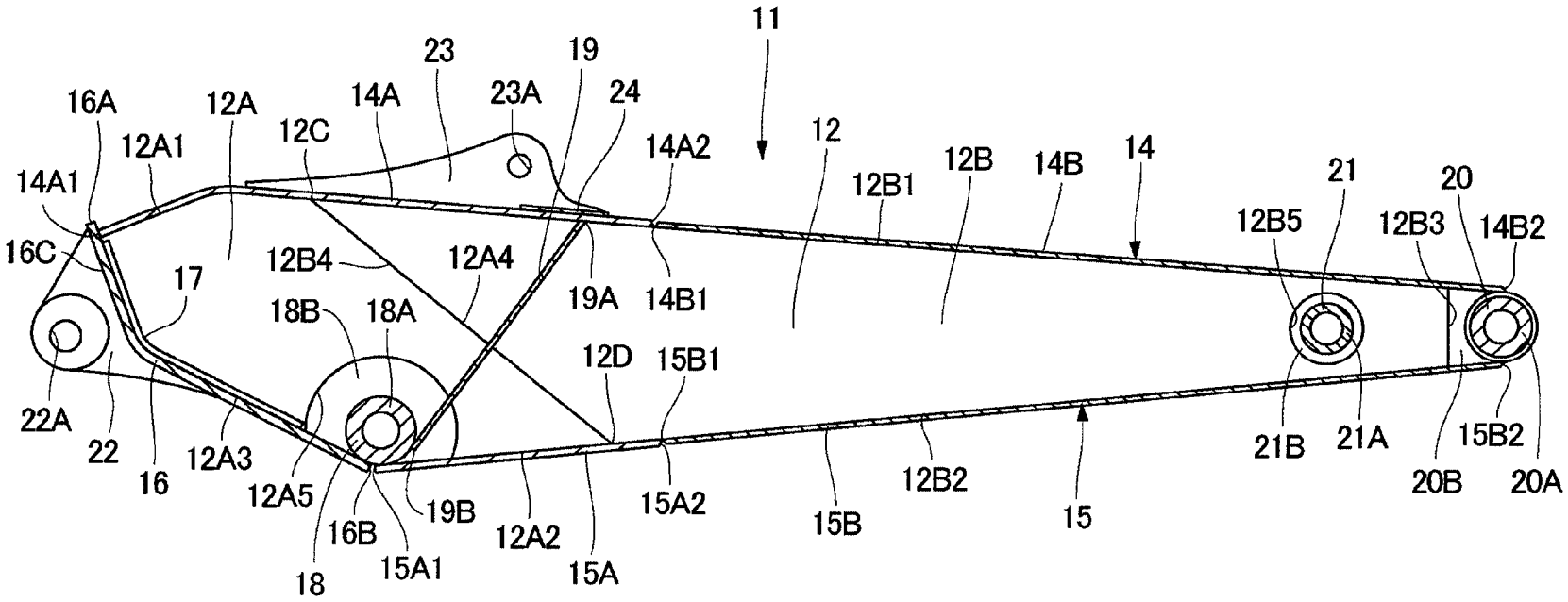
FIG. 4 is a sectional view of the arm seen from an arrow IV-IV direction in FIG. 3.
Figure 8:
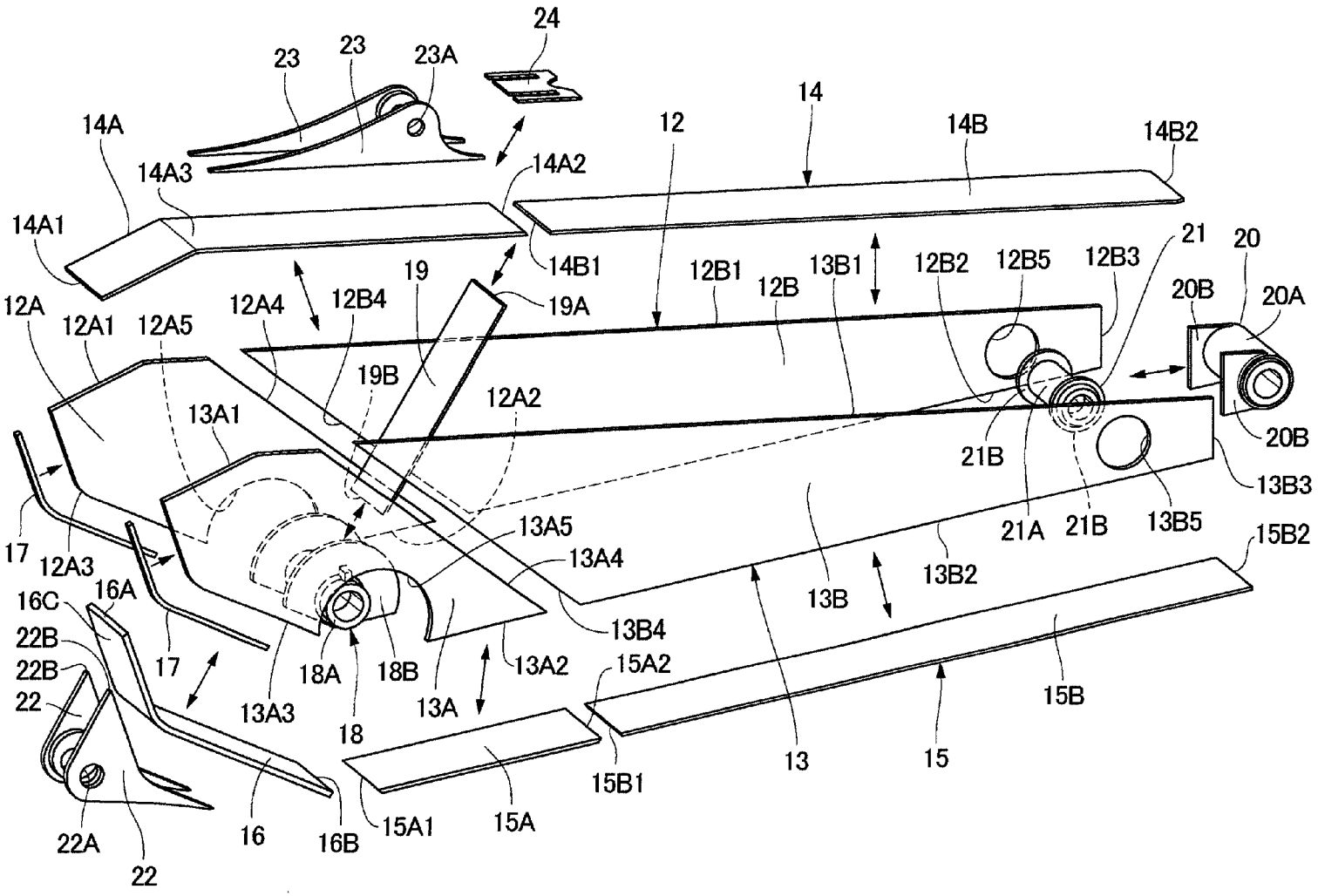
FIG. 8 is an exploded perspective view illustrating a side plate, an upper plate, a lower plate, a rear plate, a boom connecting boss, an arm cylinder bracket, a bucket cylinder bracket and the like constituting the arm in an exploded state.

Designated at 12 is a left side plate constituting a left side surface of the arm 11. The left side plate 12 extends in the front-rear direction while facing a right side plate 13 which will be described later in the left-right direction. Here, as illustrated in FIGS. 4 and 8, the left side plate 12 is formed by joining two members, that is, a rear thick side plate 12A located on the rear side in the front-rear direction and a front thin side plate 12B located on the front side in the front-rear direction. The boom connecting boss 18 which will be described later is fixed to the rear thick side plate 12A, and the bucket connecting boss 20 and the rear link connecting boss 21 which will be described later are fixed to the front thin side plate 12B.

The rear thick side plate 12A is formed by using a plate material such as a steel plate material having a large plate thickness and has a hexagonal shape surrounded by an upper plate joining part 12A1, a lower plate joining part 12A2, a rear plate joining part 12A3, and a front thin side plate joining part 12A4. In this case, the front thin side plate joining part 12A4 is configured to ensure a large length of a joint portion between the rear thick side plate 12A and the front thin side plate 12B by extending diagonally forward from the upper plate joining part 12A1 to the lower plate joining part 12A2. A corner portion where the lower plate joining part 12A2 and the rear plate joining part 12A3 intersect each other, a boom connecting boss joining groove 12A5 cut out in an arc shape is provided for joining a flange portion 18B of the boom connecting boss 18.

On the other hand, the front thin side plate 12B is formed by using a plate material such as a steel plate material having a plate thickness smaller than that of the rear thick side plate 12A and has a square shape surrounded by an upper plate joining part 12B1, a lower plate joining part 12B2, a bucket connecting boss joining part 12B3, and a rear thick side plate joining part 12B4. In this case, the rear thick side plate joining part 12B4 extends diagonally forward from the upper plate joining part 12B1 to the lower plate joining part 12B2. On the front end side of the front thin side plate 12B, a rear link connecting boss joining hole 12B5 made of a circular hole for joining a flange portion 21B of the rear link connecting boss 21 is provided.

In a state where the front thin side plate joining part 12A4 of the rear thick side plate 12A and the rear thick side plate joining part 12B4 of the front thin side plate 12B are abutted to each other, by applying butt welding between the both, the left side plate 12 in which the two members, that is, the rear thick side plate 12A and the front thin side plate 12B are joined is formed.

Figure 6:
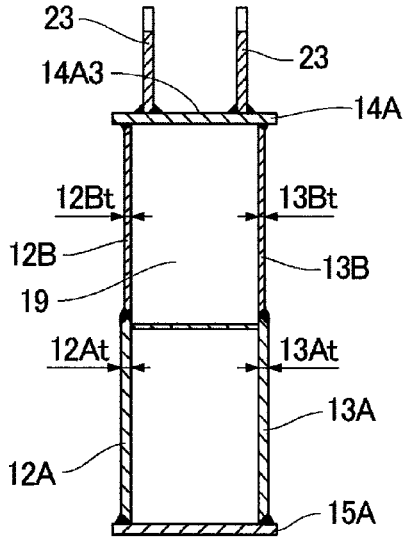
FIG. 6 is a sectional view of left and right side plates, the rear thick upper plate, the rear thick lower plate and the like seen from an arrow VI-VI direction in FIG. 5.
Figure 7:
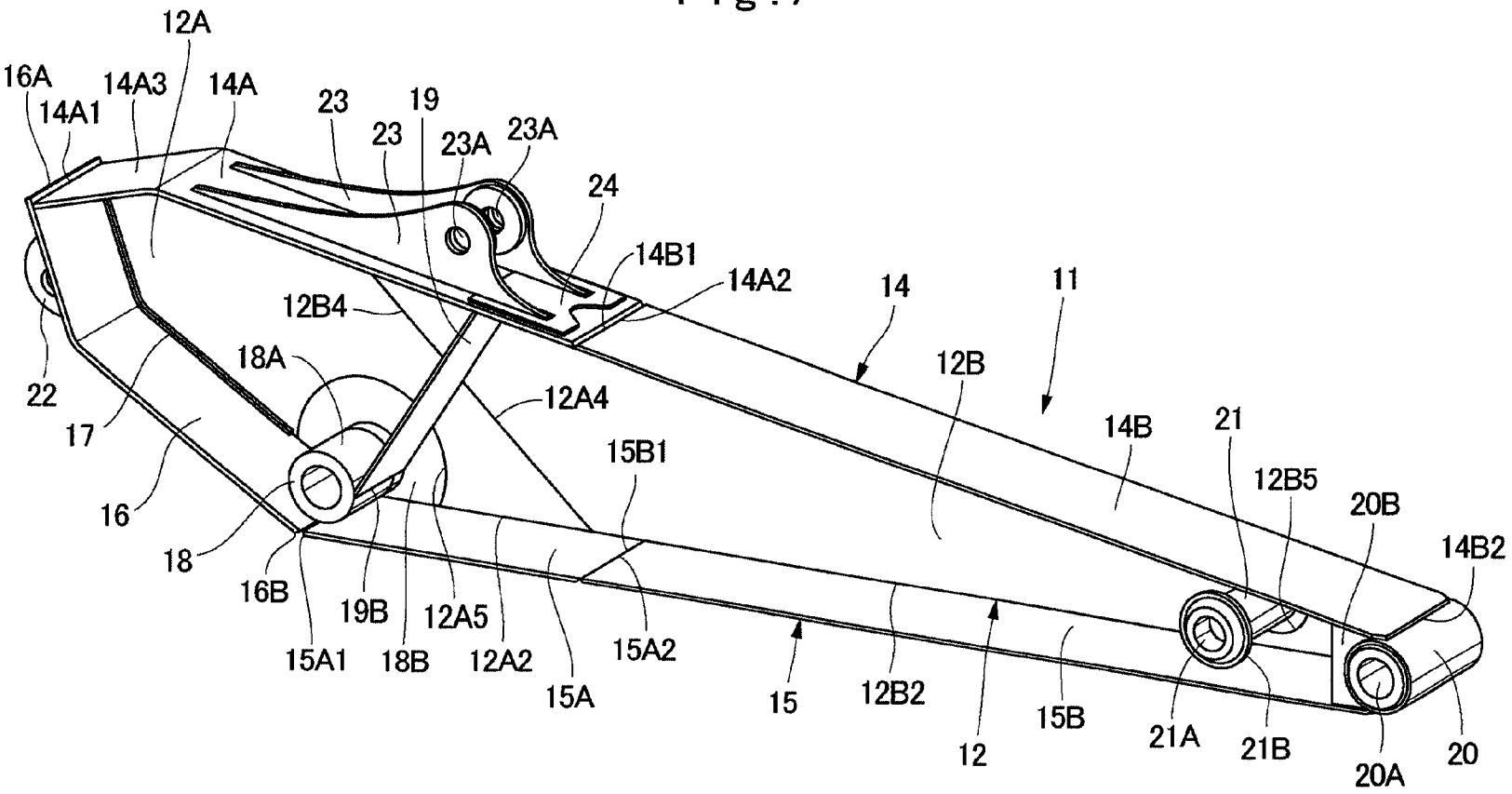
FIG. 7 is a perspective view illustrating an inside of the arm in a state where the right side plate is removed.

In this case, as illustrated in FIG. 6, assuming that a plate thickness of the rear thick side plate 12A constituting the left side plate 12 is 12At and a plate thickness of the front thin side plate 12B is 12Bt, a relationship between the plate thickness 12At and the plate thickness 12Bt is set as in the following Formula 1.

$$12At > 12Bt \quad \text{[Formula 1]}$$

Designated at 13 is a right sideplate constituting a right side surface of the arm 11, and the right side plate 13 has the same shape as that of the left side plate 12. Namely, the right side plate 13 is formed by joining two members, that is, a rear thick side plate 13A located on the rear side in the front-rear direction and a front thin side plate 13B located on the front side in the front-rear direction. The boom connecting boss 18 which will be described later is fixed to the rear thick side plate 13A, while the bucket connecting boss 20 and the rear link connecting boss 21 which will be described later are fixed to the front thin side plate 13B.

The rear thick side plate 13A is formed by using a plate material such as a steel plate material having a large plate thickness and has a hexagonal shape surrounded by an upper plate joining part 13A1, a lower plate joining part 13A2, a rear plate joining part 13A3, and a front thin side plate joining part 13A4. At a corner portion where the lower plate joining part 13A2 and the rear plate joining part 13A3 intersect each other, a boom connecting boss joining groove 13A5 cut out in an arc shape is provided.

On the other hand, the front thin side plate 13B is formed by using a plate material such as a steel plate material having a plate thickness smaller than that of the rear thick side plate 13A and has a square shape surrounded by an upper plate joining part 13B1, a lower plate joining part 13B2, a bucket connecting boss joining part 13B3, and a rear thick side plate joining part 13B4. On the front end side of the front thin side plate 13B, a rear link connecting boss joining hole 13B5 made of a circular hole is provided.

In a state where the front thin side plate joining part 13A4 of the rear thick side plate 13A and the rear thick side plate joining part 13B4 of the front thin side plate 13B are abutted to each other, by applying butt welding between the both, the right side plate 13 in which the two members, that is, the rear thick side plate 13A and the front thin side plate 13B are joined is formed.

In this case, as illustrated in FIG. 6, assuming that a plate thickness of the rear thick side plate 13A constituting the right sideplate 13 is 13At and a plate thickness of the front thin side plate 13B is 13Bt, a relationship between the plate thickness 13At and the plate thickness 13Bt is set as in the following Formula 2.

$$13At > 13Bt \quad \text{[Formula 2]}$$

Subsequently, designated at 14 is an upper plate constituting an upper surface of the arm 11. This upper plate 14 is joined to the upper end sides of the left and right side plates 12 and 13 and extends in the front-rear direction. Here, the upper plate 14 is formed by joining two members, that is, a rear thick upper plate 14A located on the rear side of the front-rear direction and a front thin upper plate 14B located on the front side of the front-rear direction.

The rear thick upper plate 14A is formed having a rectangular plate shape extending in the front-rear direction by using a plate material such as a steel plate material having a large plate thickness and the like, and a portion on the rear side of the bucket cylinder bracket 23 is slightly bent diagonally downward. A rear end edge of the rear thick upper plate 14A becomes a rear plate joining part 14A1 to be joined to the thick rear plate 16 which will be described later, and a front end edge of the rear thick upper plate 14A becomes a front thin upper plate joining part 14A2 to be joined to the front thin upper plate 14B. The bucket cylinder bracket 23 which will be described later is joined to an outer surface 14A3 of the rear thick upper plate 14A.

On the other hand, the front thin upper plate 14B is formed having a rectangular flat plate shape extending in the front-rear direction by using a plate material such as a steel plate material having a plate thickness smaller than that of the rear thick upper plate 14A. A rear end edge of the front thin upper plate 14B becomes a rear thick upper plate joining part 14B1 and a front end edge of the front thin upper plate 14B becomes a bucket connecting boss joining part 14B2 to be joined to the bucket connecting boss 20 which will be described later.

In a state where the front thin upper plate joining part 14A2 of the rear thick upper plate 14A and the rear thick upper plate joining part 14B1 of the front thin upper plate 14B are abutted to each other, by applying butt welding between the both, the upper plate 14 in which the two members, that is, the rear thick upper plate 14A and the front thin upper plate 14B are joined is formed.

Figure 5:
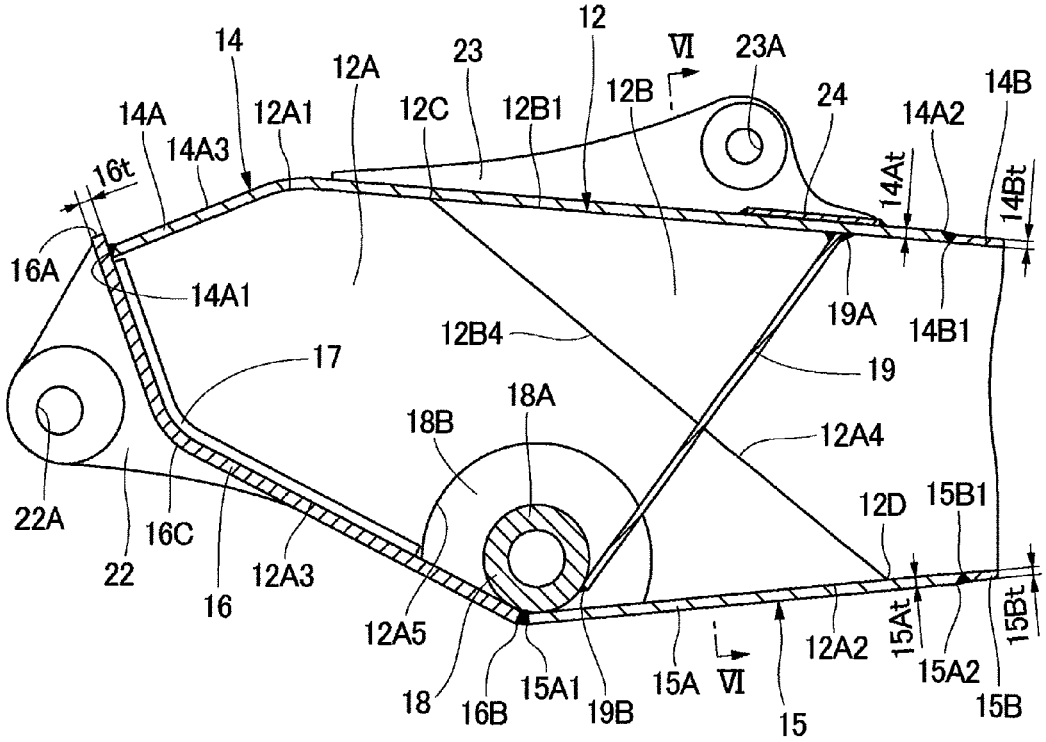
FIG. 5 is an enlarged sectional view illustrating a rear thick upper plate, a front thin upper plate, a rear thick lower plate, a front thin lower plate, a thick rear plate and the like in FIG. 4.

In this case, as illustrated in FIG. 5, assuming that a plate thickness of the rear thick upper plate 14A constituting the upper plate 14 is 14At and a plate thickness of the front thin upper plate 14B is 14Bt, a relationship between the plate thickness 14At and the plate thickness 14Bt is set as in the following Formula 3.

$$14At > 14Bt \quad \text{[Formula 3]}$$

Subsequently, designated at 15 is a lower plate constituting a lower surface of the arm 11. This lower plate 15 is joined to the lower end sides of the left and right side plates 12 and 13 and extends in the front-rear direction. Here, the lower plate 15 is formed by joining two members, that is, a rear thick lower plate 15A located on the rear side of the front-rear direction and a front thin lower plate 15B located on the front side of the front-rear direction.

The rear thick lower plate 15A is formed having a rectangular flat plate shape extending in the front-rear direction by using a plate material such as a steel plate material having a large plate thickness and the like. A rear end edge of the rear thick lower plate 15A becomes a boom connecting boss joining part 15A1 to be joined to the boom connecting boss 18 which will be described later. A front end edge of the rear thick lower plate 15A becomes a front thin lower plate joining part 15A2 to be joined to the front thin lower plate 15B.

On the other hand, the front thin lower plate 15B is formed having a rectangular flat plate shape extending in the front-rear direction by using a plate material such as a steel plate material having a plate thickness smaller than that of the rear thick lower plate 15A. A rear end edge of the front thin lower plate 15B becomes a rear thick lower plate joining part 15B1. A front end edge of the front thin lower plate 15B becomes a bucket connecting boss joining part 15B2 to be joined to the bucket connecting boss 20 which will be described later.

In a state where the front thin lower plate joining part 15A2 of the rear thick lower plate 15A and the rear thick lower plate joining part 15B1 of the front thin lower plate 15B are abutted to each other, by applying butt welding between the both, the lower plate 15 in which the two members, that is, the rear thick lower plate 15A and the front thin lower plate 15B are joined is formed.

In this case, as illustrated in FIG. 5, assuming that a plate thickness of the rear thick lower plate 15A constituting the lower plate 15 is 15At and a plate thickness of the front thin lower plate 15B is 15Bt, a relationship between the plate thickness 15At and the plate thickness 15Bt is set as in the following Formula 4.

$$15At > 15Bt \quad \text{[Formula 4]}$$

Subsequently, designated at 16 is a thick rear plate as a rear plate constituting a rear surface of the arm 11. This thick rear plate 16 is formed having a rectangular plate shape busing a plate material such as a steel plate material and the like, and a center part in the length direction is bent in a mountain shape (See FIG. 5). A plate thickness 16*t* of this thick rear plate 16 is equal to or larger than the plate thickness 12At of the rear thick side plate 12A constituting the left side plate 12, the plate thickness 13At of the rear thick side plate 13A constituting the right side plate 13, the plate thickness 14At of the rear thick upper plate 14A constituting the upper plate 14, and the plate thickness 15At of the rear thick lower plate 15A constituting the lower plate 15 and they are set as in the following Formula 5. Moreover, in the thick rear plate 16, an upper end 16A has a length dimension protruding upward from the outer surface 14A3 of the rear thick upper plate 14A.

$$16t \geq 12At, 13At, 14At, 15At \quad \text{[Formula 5]}$$

Here, the thick rear plate 16 is joined to the rear end sides of the left and right side plates 12 and 13 and the upper plate 14 by welding and closes the rear end of the hollow arm 11. In this case, the thick rear plate 16 is joined to the rear plate joining part 12A3 of the rear thick side plate 12A constituting the left side plate 12, the rear plate joining part 13A3 of the rear thick sideplate 13A constituting the right side plate 13, and the rear plate joining part 14A1 of the rear thick upper plate 14A constituting the upper plate 14 by welding.

Figure 9:
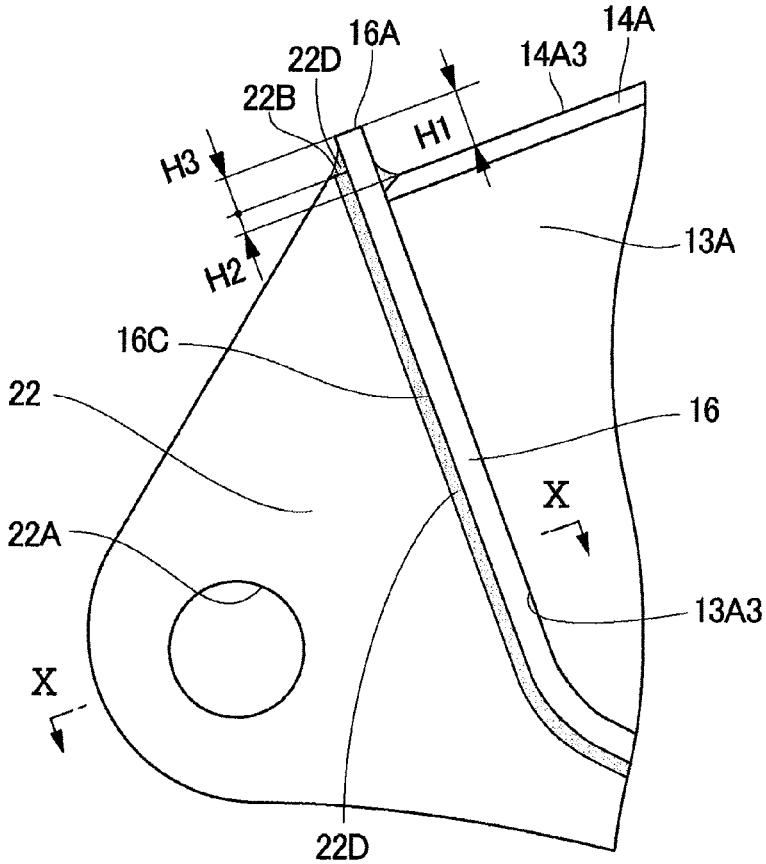
FIG. 9 is an enlarged view of essential portions illustrating the upper plate, the thick rear plate, the arm cylinder bracket and the like in an enlarged state in FIG. 2.

In this case, as illustrated in FIG. 9, the upper end 16A of the thick rear plate 16 protrudes upward from the height position of the outer surface 14A3 of the rear thick upper plate 14A only by a height dimension H1. The front end edge of the thick rear plate 16 becomes a boom connecting boss joining part 16B to be joined to a boom connecting boss 18 which will be described later. An outer surface 16C of the thick rear plate 16 is configured such that the arm cylinder bracket 22 which will be described later is fixed.

Fillet welding is applied between the upper plate joining part 12A1 of the rear thick side plate 12A constituting the left side plate 12 and the upper plate 14 and between the upper plate joining part 12B1 of the front thin side plate 12B and the upper plate 14, respectively. On the other hand, fillet welding is applied between the upper plate joining part 13A1 of the rear thick side plate 13A constituting the right side plate 13 and the upper plate 14 and between the upper plate joining part 13B1 of the front thin side plate 13B and the upper plate 14, respectively. As a result, the upper plate 14 is firmly joined to the upper end portions of the left and right side plates 12 and 13.

Moreover, fillet welding is applied between the lower plate joining part 12A2 of the rear thick side plate 12A constituting the left side plate 12 and the lower plate 15 and between the lower plate joining part 12B2 of the front thin side plate 12B and the lower plate 15, respectively. On the other hand, fillet welding is applied between the lower plate joining part 13A2 of the rear thick side plate 13A constituting the right side plate 13 and the lower plate 15 and between the lower plate joining part 13B2 of the front thin side plate 13B and the lower plate 15, respectively. As a result, the lower plate 15 is firmly joined to the lower ends of the left and right side plates 12 and 13.

Moreover, fillet welding is applied between the rear plate joining part 12A3 of the rear thick side plate 12A constituting the left sideplate 12 and the thick rear plate 16, and similarly, fillet welding is applied between the rear plate joining part 13A3 of the rear thick sideplate 13A constituting the right side plate 13 and the thick rear plate 16. On the other hand, fillet welding is also applied between the rear plate joining part 14A1 of the rear thick upper plate 14A constituting the upper plate 14 and the thick rear plate 16. As a result, the thick rear plate 16 is firmly joined to the rear end sides of the left and right side plates 12 and 13 and the upper plate 14.

Figure 2:
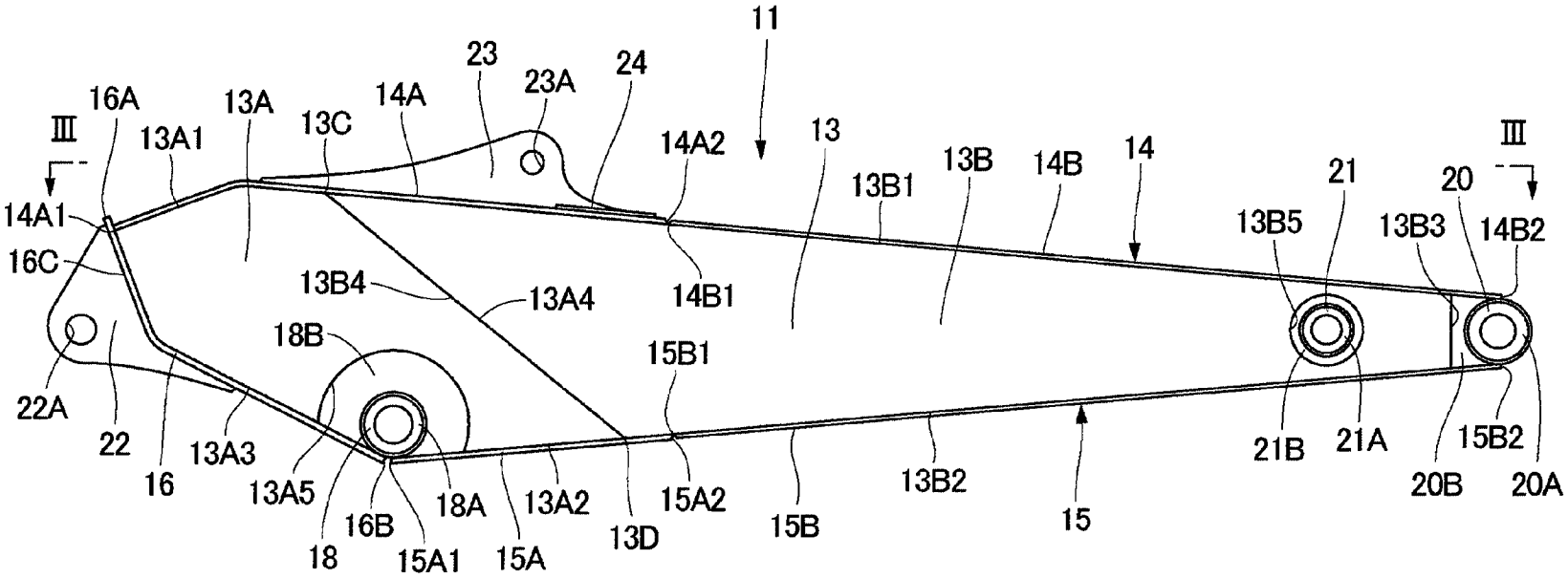
FIG. 2 is a front view illustrating the arm as a single body.

Here, as illustrated in FIGS. 4 and 5, an upper end 12C of a joint portion between the rear thick side plate 12A and the front thin side plate 12B constituting the left side plate 12 is joined at a position of an intermediate portion of the rear thick upper plate 14A, and a lower end 12D is joined at a position of the front side of the rear thick lower plate 15A. On the other hand, as illustrated in FIG. 2, regarding the joint portion between the rear thick side plate 13A and the front thin side plate 13B constituting the right side plate 13, the upper end 13C is joined at a position of the intermediate portion of the rear thick upper plate 14A, and a lower end 13D is joined at a position of the front part side of the rear thick lower plate 15A.

Designated at 17 are left and right backing materials provided between the rear thick side plate 12A of the left side plate 12 and the thick rear plate 16 and between the rear thick side plate 13A of the right side plate 13 and the thick rear plate 16, respectively. This backing material 17 is formed by bending an elongated square material into a mountain shape, for example, and is fixed to inner surfaces of the rear plate joining parts 12A3 and 13A3 of the rear thick side plates 12A and 13A by spot welding and the like.

It is configured such that a space between the rear plate joining part 12A3 of the rear thick side plate 12A constituting the left side plate 12 and the thick rear plate 16 is fillet-welded by using the backing material 17, and a space between the rear plate joining part 13A3 of the rear thick side plate 13A constituting the right side plate 13 and the thick rear plate 16 is fillet-welded by using the backing material 17. As a result, these fillet welding parts become perfect welding.

Subsequently, designated at 18 is a boom connecting boss provided on the rear parts on the lower sides of the left and right side plates 12 and 13. A connecting pin (not shown) rotatably connecting the boom 5 and the arm 11 is inserted into this boom connecting boss 18. Here, the boom connecting boss 18 is composed of a hollow cylindrical boss portion 18A extending in the left-right direction and left and right flange portions 18B made of arc-shaped flat plates provided on both end sides in the left-right direction of the cylindrical boss portion 18A.

The cylindrical boss portion 18A of the boom connecting boss 18 is joined to the boom connecting boss joining part 15A1 of the rear thick lower plate 15A and to the boom connecting boss joining part 16B of the thick rear plate 16 by welding. The left side flange portion 18B of the boom connecting boss 18 is joined to the boom connecting boss joining groove 12A5 of the rear thick side plate 12A, and the right side flange portion 18B is joined to the boom connecting boss joining groove 13A5 of the rear thick side plate 13A.

Designated at 19 is an internal partition wall provided between the inner surface of the rear thick upper plate 14A of the upper plate 14 and the boom connecting boss 18. This internal partition wall 19 is arranged so as to form two closed spaces in the arm 11 and improves rigidity of the arm 11. This internal partition wall 19 is formed of a rectangular flat plate having a width dimension in the left-right direction substantially equal to an interval between the left and right side plates 12 and 13.

Here, as illustrated in FIGS. 4 and 5, an upper end 19A of the internal partition wall 19 is joined to a position in the vicinity of a joint portion between the rear thick upper plate 14A and the front thin upper plate 14B by welding. A lower end 19B of the internal partition wall 19 is joined to the cylindrical boss portion 18A of the boom connecting boss 18 by welding. On the other hand, a left side end of the internal partition wall 19 is joined to the rear thick side plate 12A and the front thin side plate 12B of the left side plate 12 by welding, and a right side end is joined to the rear thick side plate 13A and the front thin side plate 13B of the right side plate 13 by welding.

Designated at 20 is a bucket connecting boss provided on the front end parts of the left and right side plates 12 and 13, the upper plate 14 and the lower plate 15. A connecting pin (not shown) rotatably connecting the bucket 6 and the arm 11 is inserted into the bucket connecting boss 20. This bucket connecting boss 20 is composed of a hollow cylindrical boss portion 20A extending in the left-right direction and left and right flange portions 20B each having a flat plate shape provided on the both end sides in the left-right direction of the cylindrical boss portion 20A.

Here, the cylindrical boss portion 20A of the bucket connecting boss 20 is joined to the bucket connecting boss joining part 14B2 of the front thin upper plate 14B and the bucket connecting boss joining part 15B2 of the front thin lower plate 15B by welding. The left side flange portion 20B of the bucket connecting boss 20 is joined to the bucket connecting boss joining part 12B3 of the front thin side plate 12B, and the right side flange portion 20B is joined to the bucket connecting boss joining part 13B3 of the front thin side plate 13B.

Designated at 21 is the rear link connecting boss provided on the front end sides of the left and right side plates 12 and 13 adjacent to the bucket connecting boss 20. A connecting pin (not shown) rotatably connecting the rear link 7A of the bucket link 7 and the arm 11 is inserted into the rear link connecting boss 21. Here, the rear link connecting boss 21 is composed of a hollow cylindrical boss portion 21A extending in the left-right direction and disk-shaped left and right flange portions 21B provided on the both end sides in the left-right direction of the cylindrical boss portion 21A. The left side flange portion 21B of the rear link connecting boss 21 is joined to the rear link connecting boss joining hole 12B5 of the front thin side plate 12B, and the right side flange portion 21B is joined to the rear link connecting boss joining hole 13B5 of the front thin side plate 13B.

Next, the pair of arm cylinder brackets 22 in the left-right direction according to this embodiment will be described.

That is, designated at 22 is a pair of arm cylinder brackets provided on the outer surface 16C of the thick rear plate 16, and each of the arm cylinder brackets 22 is arranged forming a pair in the left-right direction. To each of the arm cylinder brackets 22, a rod distal end of the arm cylinder 9 is rotatably connected through a connecting pin (not shown). Here, each of the arm cylinder brackets 22 is formed having a substantially triangular plate body by using a plate material such as a steel plate material and the like, and a pin insertion hole 22A through which the above-described connecting pin is inserted is drilled in the center part thereof. Each of the arm cylinder brackets 22 is joined to the outer surface 16C of the thick rear plate 16 by welding in a state where a predetermined interval is kept in the left-right direction.

In this case, as illustrated in FIG. 9, an upper end 22B of each of the arm cylinder brackets 22 is arranged at a position higher than the height position of the outer surface 14A3 of the rear thick upper plate 14A only by a height dimension H2, and is arranged at a position lower than the upper end 16A of the thick rear plate 16 only by a height dimension H3.

Therefore, a relationship among the height dimension H1 from the outer surface 14A3 of the rear thick upper plate 14A to the upper end 16A of the thick rear plate 16, the height dimension H2 from the outer surface 14A3 of the rear thick upper plate 14A to the upper end 22B of each of the arm cylinder brackets 22, and the height dimension H3 from the upper end 22B of each of the arm cylinder brackets 22 to the upper end 16A of the thick rear plate 16 is as in the following Formula 6.

$$H1=H2+H3 \quad \text{[Formula 6]}$$

Therefore, a facing area in which the front end of each of the arm cylinder brackets 22 and the outer surface 16C of the thick rear plate 16 are faced with each other, that is, a joint area can be formed large. As a result, strength of each of the arm cylinder brackets 22 itself can be improved against a load acting on each of the arm cylinder brackets 22 caused by extension/contraction of the arm cylinder 9. Moreover, it is configured such that a welding length between each of the arm cylinder brackets 22 and the outer surface 16C of the thick rear plate 16 can be made larger and joint strength of each of the arm cylinder brackets 22 to the thick rear plate 16 can be improved.

Figure 10:
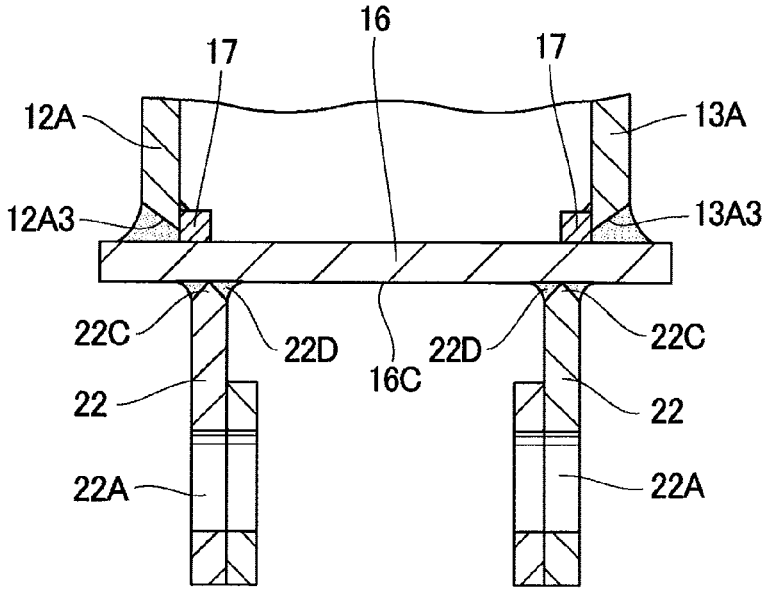
FIG. 10 is a sectional view of a joint portion between the thick rear plate and the arm cylinder bracket seen from an arrow X-X direction in FIG. 9.

Here, as illustrated in FIG. 10, a groove 22C having a mountain shape without a root face is formed on an end face in each of the arm cylinder brackets 22 brought into contact with the outer surface 16C of the thick rear plate 16. By abutting this groove 22C to the outer surface 16C of the thick rear plate 16, a K-shaped groove is formed between the both.

It should be noted that the root face is a surface formed on each of the two members to be welded and brought into contact with each other during welding. Therefore, by applying groove fillet welding at the position of the groove 22C, in a state where each of the arm cylinder brackets 22 is blended over the whole region of the plate thickness, a welding bead 22D smoothly continuing between each of the arm cylinder brackets 22 and the thick rear plate 16 can be formed.

As a result, each of the arm cylinder brackets 22 can be firmly joined to the thick rear plate 16. In this case, as illustrated in FIG. 9 the smoothly continuing welding bead 22D can be formed also between the upper end 22B of each of the arm cylinder brackets 22 and the outer surface 16C of the thick rear plate 16. It should be noted that the groove 22C provided on the arm cylinder bracket 22 is not limited to the mountain-shaped groove but may be a groove having other shapes such as a V-shaped groove.

Designated at 23 is a pair of bucket cylinder brackets provided on the outer surface 14A3 on the rear end side of the upper plate 14, and each of the bucket cylinder brackets 23 is arranged forming a pair in the left-right direction. To each of these bucket cylinder brackets 23, the bottom side of the bucket cylinder 10 is rotatably connected through a connecting pin (not shown). Here, each of the bucket cylinder brackets 23 is formed as a substantially triangular plate body by using a plate material such as a steel plate material and the like, and a pin insertion hole 23A through which the above-described connecting pin is inserted is drilled in the center part thereof. Moreover, each of the bucket cylinder brackets 23 is joined to the outer surface 14A3 of the rear thick upper plate 14A constituting the upper plate 14 by welding in a state where a predetermined interval is kept in the left-right direction.

Figure 3:
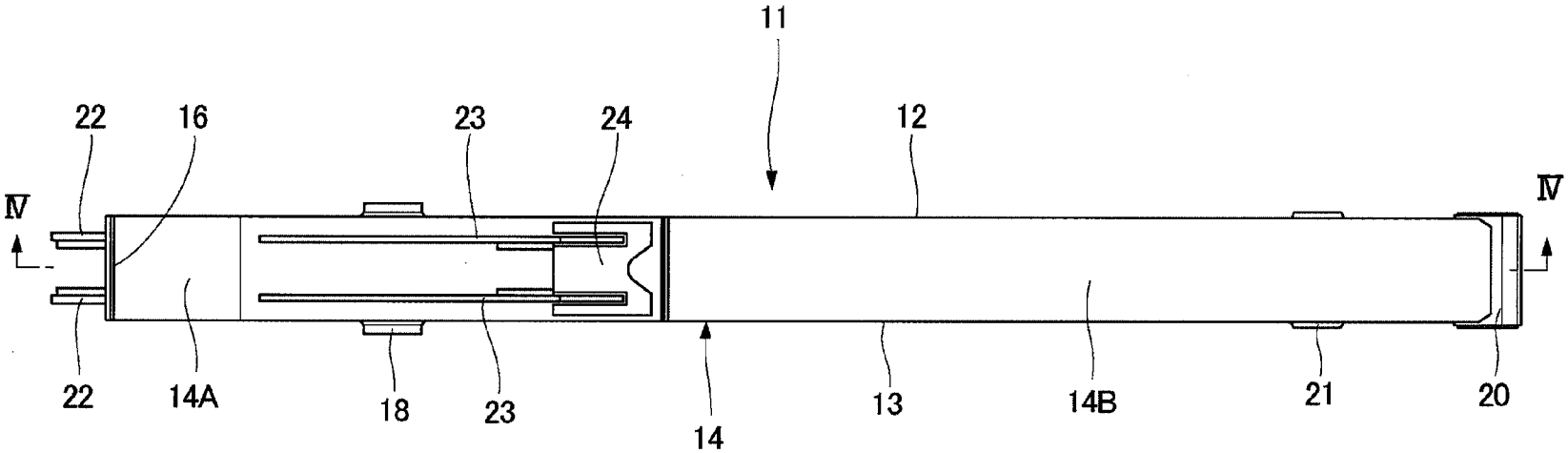
FIG. 3 is a plan view of the arm seen from an arrow direction in FIG. 2.

Subsequently, designated at 24 is an auxiliary welding member provided on the outer surface 14A3 of the rear end side of the upper plate 14, and as illustrated in FIG. 3, the auxiliary welding member 24 is formed as a flat plate having a substantially M-shaped on a plan view. This auxiliary welding member 24 is joined to the outer surface 14A3 of the rear thick upper plate 14A so as to surround the welding portion with the rear thick upper plate 14A of the upper plate 14 and each of the bucket cylinder brackets 23 by welding.

Therefore, a welding portion (welding bead portion) formed between each of the bucket cylinder brackets 23 and the rear thick upper plate 14A can be embedded between the auxiliary welding member 24 and the rear thick upper plate 14A. As a result, joint strength of each of the bucket cylinder brackets 23 to the upper plate 14 can be improved in configuration.

The arm 11 according to this embodiment has the configuration as described above, and an example of a procedure of manufacturing this arm 11 will be described with reference to FIG. 8.

First, in a state where the front thin side plate joining part 12A4 of the rear thick side plate 12A constituting the left side plate 12 and the rear thick side plate joining part 12B4 of the front thin side plate 12B are abutted to each other, butt welding is applied between them. As a result, the left sideplate 12 in which the two members, that is, the rear thick side plate 12A and the front thin side plate 12B are joined can be formed. On the other hand, in a state where the front thin side plate joining part 13A4 of the rear thick side plate 13A constituting the right side plate 13 and the rear thick side plate joining part 13B4 of the front thin side plate 13B are abutted to each other, butt welding is applied between them. As a result, the right side plate 13 in which the two members, that is, the rear thick side plate 13A and the front thin side plate 13B are joined can be formed. In this case, the backing material 17 is fixed in advance by spot welding or the like to an inner surface of the rear plate joining part 12A3 of the rear thick side plate 12A constituting the left side plate 12 and an inner surface of the rear plate joining part 13A3 of the rear thick side plate 13A constituting the right side plate 13, respectively.

Subsequently, to the boom connecting boss joining groove 12A5 of the left side plate 12 and the boom connecting boss joining groove 13A5 of the right side plate 13, the left and right flange portions 18B of the boom connecting boss 18 are joined by welding, respectively. Subsequently, to the rear link connecting boss joining hole 12B5 of the left side plate 12 and the rear link connecting boss joining hole 13B5 of the right side plate 13, the left and right flange portions 21B of the rear link connecting boss 21 are joined by welding, respectively. Moreover, to the bucket connecting boss joining part 12B3 of the left side plate 12 and the bucket connecting boss joining part 13B3 of the right side plate 13, the left and right flange portions 20B of the bucket connecting boss 20 are joined by welding, respectively.

On the other hand, in a state where the front thin upper plate joining part 14A2 of the rear thick upper plate 14A constituting the upper plate 14 and the rear thick upper plate joining part 14B1 of the front thin upper plate 14B are abutted to each other, butt welding is applied between them. As a result, the upper plate 14 in which the two members, that is, the rear thick upper plate 14A and the front thin upper plate 14B are joined can be formed.

Subsequently, in a state where the front thin lower plate joining part 15A2 of the rear thick lower plate 15A constituting the lower plate 15 and the rear thick lower plate joining part 15B1 of the front thin lower plate 15B are abutted to each other, butt welding is applied between them. As a result, the lower plate 15 in which the two members, that is, the rear thick lower plate 15A and the front thin lower plate 15B are joined can be formed.

Subsequently, the upper plate 14 is arranged on the upper end sides of the left side plate 12 and the right side plate 13, and fillet welding is applied over the whole length between the left side plate 12 and the upper plate 14. Similarly, fillet welding is applied over the whole length between the right side plate 13 and the upper plate 14. Moreover, the bucket connecting boss joining part 14B2 of the front thin upper plate 14B constituting the upper plate 14 is joined to the cylindrical boss portion 20A of the bucket connecting boss 20 by welding. As a result, the upper plate 14 can be joined to the upper end sides of the left and right side plates 12 and 13.

On the other hand, the internal partition wall 19 is prepared, and the upper end 19A of this internal partition wall 19 is welded to a portion in the vicinity of the front thin upper plate joining part 14A2 of the rear thick upper plate 14A. Further, the lower end 19B of the internal partition wall 19 is welded to the cylindrical boss portion 18A of the boom connecting boss 18.

Subsequently, a lower plate 15 is arranged on the lower end sides of the left side plate 12 and the right side plate 13, and fillet welding is applied to the whole length between the left side plate 12 and the lower plate 15. Similarly to this, fillet welding is applied to the whole length between the right sideplate 13 and the lower plate 15. On the other hand, the boom connecting boss joining part 15A1 of the rear thick lower plate 15A is joined to the cylindrical boss portion 18A of the boom connecting boss 18 by welding. Moreover, the bucket connecting boss joining part 15B2 of the front thin lower plate 15B is joined to the cylindrical boss portion 20A of the bucket connecting boss 20 by welding. As a result, the lower plate 15 can be joined to the lower end sides of the left and right side plates 12 and 13.

As described above, the upper plate 14 is joined to the upper end sides of the left and right side plates 12 and 13 and the lower plate 15 is joined to the lower end sides, and then, the thick rear plate 16 is prepared. In a state where this thick rear plate 16 is brought into contact with the backing material 17 fixed to the rear thick side plate 12A of the left side plate 12, groove fillet welding is applied between the rear plate joining part 12A3 of the rear thick side plate 12A and the thick rear plate 16. Similarly to this, in a state where the thick rear plate 16 is brought into contact with the backing material 17 fixed to the rear thick side plate 13A of the right side plate 13, groove fillet welding is applied between the rear plate joining part 13A3 of the rear thick side plate 13A and the thick rear plate 16.

On the other hand, groove fillet welding is applied between the rear plate joining part 14A1 of the rear thick upper plate 14A and the thick rear plate 16. Moreover, the boom connecting boss joining part 16B of the thick rear plate 16 is welded to the cylindrical boss portion 18A of the boom connecting boss 18. At this time, as illustrated in FIG. 9, the upper end 16A of the thick rear plate 16 protrudes upward from the outer surface 14A3 of the rear thick upper plate 14A only by the height dimension H1.

Subsequently, to the outer surface 14A3 of the rear thick upper plate 14A constituting the upper plate 14, a pair of bucket cylinder brackets 23 are joined by welding. Moreover, the M-shaped auxiliary welding member 24 is arranged on the outer surface 14A3 of the rear thick upper plate 14A so as to surround a welding portion between the rear thick upper plate 14A and each of the bucket cylinder brackets 23. By welding this auxiliary welding member 24 to the rear thick upper plate 14A, joint strength of each of the bucket cylinder brackets 23 to the rear thick upper plate 14A is improved.

Subsequently, the pair of left and right arm cylinder brackets 22 are joined to the outer surface 16C of the thick rear plate 16. In this case, as illustrated in FIG. 10, the groove 22C without a root face is provided on the end face of each of the arm cylinder brackets 22. Therefore, by applying groove fillet welding at the position of this groove 22C, each of the arm cylinder brackets 22 can be blended over the whole region of the plate thickness. As a result, the welding bead 22D smoothly continuing between each of the arm cylinder brackets 22 and the thick rear plate 16 can be formed, and each of the arm cylinder brackets 22 can be firmly joined to the thick rear plate 16. Similarly to this, as illustrated in FIG. 9, the smoothly continuing welding bead 22D can be formed also between the upper end 22B of each of the arm cylinder brackets 22 and the outer surface 16C of the thick rear plate 16. As a result, the upper end 22B of each of the arm cylinder brackets 22 can be firmly joined to the thick rear plate 16.

At this time, as illustrated in FIG. 9, the upper end 22B of each of the arm cylinder brackets 22 is arranged at a position higher than the height position of the outer surface 14A3 of the rear thick upper plate 14A only by the height dimension H2 and at a position lower than the upper end 16A of the thick rear plate 16 only by the height dimension H3. As a result, each of the arm cylinder brackets 22 can be formed having a large joint area facing the outer surface 16C of the thick rear plate 16.

As described above, by welding the left and right side plates 12 and 13, the upper plate 14, the lower plate 15, the thick rear plate 16 and the like to each other, the arm 11 having a square cross sectional surface with a closed sectional structure can be formed.

In this case, according to this embodiment, the upper end 16A of the thick rear plate 16 is made to protrude upward from the outer surface 14A3 of the rear thick upper plate 14A constituting the upper plate 14. Moreover, the upper ends 22B of the left and right arm cylinder brackets 22 joined to the outer surface 16C of the thick rear plate 16 are arranged higher than the outer surface 14A3 of the rear thick upper plate 14A and lower than the upper end 16A of the thick rear plate 16.

Therefore, in each of the arm cylinder brackets 22, an area facing the thick rear plate 16, that is, the joint area with the thick rear plate 16 can be formed large. As a result, strength of each of the arm cylinder brackets 22 itself can be improved against the load caused by extension/contraction of the arm cylinder 9. In addition, since the welding length between each of the arm cylinder brackets 22 and the thick rear plate 16 can be ensured large, joint strength of each of the arm cylinder brackets 22 to the thick rear plate 16 can be improved.

Moreover, by protruding the upper end 16A of the thick rear plate 16 upward from the outer surface 14A3 of the rear thick upper plate 14A, rigidity on the upper end 16A side of the thick rear plate 16 becomes relatively low. Thus, appropriate deflection according to the load acting on each of the arm cylinder brackets 22 is generated in the upper end 16A side of the thick rear plate 16.

Figure 11:
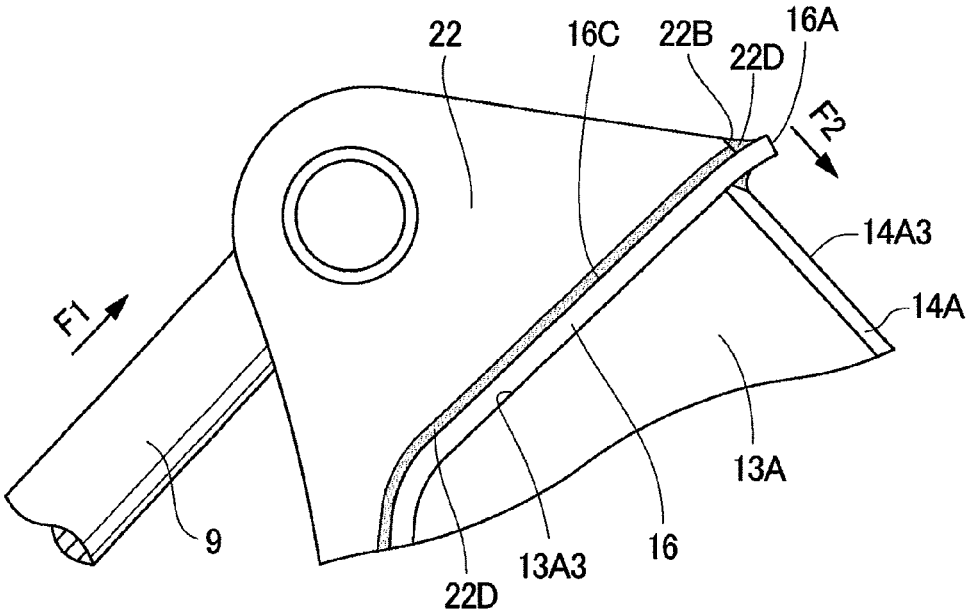
FIG. 11 is an enlarged view illustrating a state where the upper end side of the thick rear plate is deflected when the arm cylinder is extended.
Figure 12:
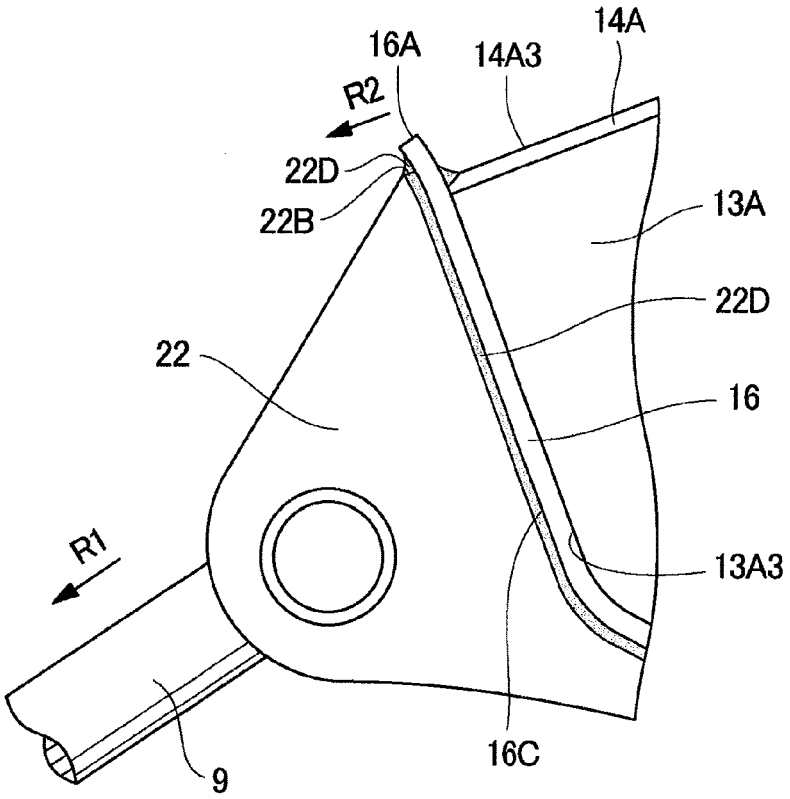
FIG. 12 is an enlarged view illustrating a state where the upper end side of the thick rear plate is deflected when the arm cylinder is contracted.

More specifically speaking, as illustrated in FIG. 11, when the arm cylinder 9 is extended in an arrow F1 direction, appropriate deflection is generated in an arrow F2 direction on the upper end 16A side of the thick rear plate 16 by the load acting on the upper end 22B of the arm cylinder bracket 22 from the arm cylinder 9. On the other hand, as illustrated in FIG. 12, when the arm cylinder 9 is contracted in an arrow R1 direction, appropriate deflection is generated in an arrow R2 direction on the upper end 16A side of the thick rear plate 16 by the load acting on the upper end 22B of the arm cylinder bracket 22 from the arm cylinder 9.

As described above, the load acting on the upper end 22B of each of the arm cylinder brackets 22 caused by extension/contraction of the arm cylinder 9 can be absorbed by deflection on the upper end 16A side of the thick rear plate 16. Therefore, stress concentration generated in the joint portion (welding bead 22D) between the upper end 22B of each of the arm cylinder brackets 22 and the thick rear plate 16 can be reduced. As a result, since plate thickness of each of the arm cylinder brackets 22 can be made smaller while joint strength of the pair of arm cylinder brackets 22 to the thick rear plate 16 is ensured, weight reduction of the entire arm 11 can be realized.

On the other hand, according to this embodiment, the left side plate 12 is formed of the two members, that is, the rear thick side plate 12A and the front thin side plate 12B, and the right side plate 13 is formed of the two members, that is, the rear thick side plate 13A and the front thin side plate 13B, and thus, the left and right side plates 12 and 13 constituting the arm 11 are formed thicker on the rear side and thinner on the front side. Similarly, the upper plate 14 is formed of the two members, that is, the rear thick upper plate 14A and the front thin upper plate 14B, and the lower plate 15 is formed by the two members, that is, the rear thick lower plate 15A and the front thin lower plate 15B, and thus, the upper plate 14 and the lower plate 15 constituting the arm 11 are formed thicker on the rear side and thinner on the front side.

As a result, weight reduction of the entire arm 11 can be realized while required strength can be ensured on the rear part side of the arm 11 where the boom connecting boss 18, the arm cylinder bracket 22, the bucket cylinder bracket 23 and the like are provided. Particularly, since the upper plate 14 is formed of the two members, that is, the rear thick upper plate 14A and the front thin upper plate 14B, required strength is ensured by the rear thick upper plate 14A on the rear part side of the arm 11, and weight reduction can be realized by the front thin upper plate 14B on the front part side of the arm 11. Therefore, weight reduction of the entire arm 11 can be realized while strength of the upper plate 14 is kept. In this case, since the upper end 16A of the arm cylinder bracket 22 is arranged higher than the height position of the outer surface 14A3 of the rear thick upper plate 14A, ensuring of the deflection on the upper end side of the thick rear plate 16 and ensuring of the strength of the upper plate 14 can be both realized. Moreover, since the thick rear plate 16 is formed as a thick plate using a plate thickness equal to or larger than the rear thick upper plate 14A, weight reduction of the entire arm 11 can be realized while required strength on the rear part side of the arm 11 is ensured.

It should be noted that, in the above-described embodiment, as one example of the procedure of assembling the arm 11, the boom connecting boss 18, the bucket connecting boss 20, and the rear link connecting boss 21 are joined to the left and right side plates 12 and 13 and then, the upper plate 14 is joined to each of the side plates 12 and 13. Subsequently, the internal partition wall 19 is joined between the upper plate 14 and the boom connecting boss 18 and then, the lower plate 15 and the thick rear plate 16 are joined to each of the side plates 12 and 13, and this procedure is exemplified. However, the assembling procedure of the arm 11 according to the present invention is not limited to this embodiment, but the procedure of assembling the arm 11 can be changed as appropriate.

In the above-described embodiment, the configuration is exemplified in which the backing material 17 is fixed to the rear thick side plates 12A and 13A constituting the left and right side plates 12 and 13, and each of the rear thick side plates 12A and 13A is perfectly welded to the thick rear plate 16 by applying fillet welding using this backing material 17. However, the present invention is not limited to this, it may be so configured that simple fillet welding is applied between each of the rear thick side plates 12A and 13A and the thick rear plate 16 without using the backing material 17.

Moreover, in the above-described embodiment, the crawler-type hydraulic excavator 1 is described as an example of the construction machine. However, the present invention is not limited to this and can be widely applied to other arms for construction machine such as an arm used in a wheel-type hydraulic excavator and the like, for example.

DESCRIPTION OF REFERENCE NUMERALS

1: Hydraulic excavator (Construction machine)
11: Arm
12: Left side plate
12A, 13A: Rear thick side plate
12B, 13B: Front thin side plate
13: Right side plate
14: Upper plate
14A: Rear thick upper plate
14A3: Outer surface
14B: Front thin upper plate
15: Lower plate
15A: Rear thick lower plate
15B: Front thin lower plate
16: Thick rear plate (rear plate)
16A: Upper end
16C: Outer surface
18: Boom connecting boss
20: Bucket connecting boss
22: Arm cylinder bracket
22C: Groove

The invention claimed is:

1. An arm for a construction machine formed as a box-shaped structural body having a square cross sectional surface having left and right side plates, an upper plate joined to upper end sides of said left and right side plates by welding, a lower plate joined to lower end sides of said left and right side plates by welding, and a rear plate joined to rear end sides of said left and right side plates and to a rear end side of said upper plate by welding, comprising:

a boom connecting boss disposed on rear parts of lower sides of said left and right side plates and joined to said left and right side plates and a rear end of said lower plate and a front end of said rear plate by welding;

a bucket connecting boss joined to front ends of said left and right side plates, said upper plate, and said lower plate by welding;

a pair of left and right arm cylinder brackets joined to an outer surface of said rear plate by welding; and a pair of left and right bucket cylinder brackets joined to an outer surface of the rear end side of said upper plate by welding, wherein said upper plate has a portion that is bent diagonally downward, wherein an upper end of said rear plate protrudes upward from a height position of an outer surface of a rear end edge of the portion of said upper plate; that is bent diagonally downward, wherein upper ends of said pair of arm cylinder brackets are arranged higher than the height position of the outer surface of said rear end edge of the portion of said upper plate that is bent diagonally downward and arranged lower than said upper end of said rear plate, and wherein said pair of left and right bucket cylinder brackets are disposed on a portion of said upper plate that is forward of the portion of said upper plate that is bent diagonally downward.

2. The arm for a construction machine according to claim 1, wherein in said pair of arm cylinder brackets, a groove is disposed on an end surface of said pair of arm cylinder brackets that are in contact with said outer surface of said rear plate, and wherein said groove of each of said arm cylinder brackets and said outer surface of said rear plate are joined by fillet welding.

3. The arm for a construction machine according to claim 1, wherein said upper plate is formed of a rear thick upper plate made of a plate material having a large plate thickness and a front thin upper plate located on the front side of said rear thick upper plate and made of a plate material having a small plate thickness, which is less than the large plate thickness, and wherein the rear thick upper plate includes the portion of said upper plate on the rear side of said bucket cylinder brackets that is bent diagonally downward.

* * * * *